US005330151A

United States Patent [19]

Boyack

[11] Patent Number: 5,330,151

[45] Date of Patent: Jul. 19, 1994

[54] PARTIALLY REUSABLE SWIMMING POOL WALL FORM

[76] Inventor: John D. Boyack, Rte. 17, Box 515, Tyler, Tex. 75704

[21] Appl. No.: 922,014

[22] Filed: Jul. 29, 1992

[51] Int. Cl.[5] ..... E04B 1/16; E04H 4/02

[52] U.S. Cl. ..... 249/83; 4/506; 52/169.7; 249/91; 249/DIG. 3; 264/35

[58] Field of Search ..... 4/506; 52/169.7; 249/3-5, 10, 33, 83, 91, 96, 97, 139, DIG. 3; 264/31, 35

[56] References Cited

U.S. PATENT DOCUMENTS

| | | | |
|---|---|---|---|
| 2,873,505 | 2/1959 | Sheldon | 249/DIG. 3 |
| 3,468,088 | 9/1969 | Miller | 52/250 |
| 3,748,810 | 7/1973 | Mattingly | 52/742 |
| 4,015,379 | 4/1977 | Colson, Jr. | 249/DIG. 3 |
| 4,167,084 | 9/1979 | Brunton | 52/169.7 |
| 4,343,118 | 8/1982 | Lankheet | 52/169.7 |
| 4,407,102 | 10/1983 | Boyack | 52/169.7 |
| 4,409,772 | 10/1983 | Boyack | 52/746 |
| 4,426,061 | 1/1984 | Taggart | 249/45 |
| 4,443,982 | 4/1984 | Dalbanne | 52/169.7 |
| 4,616,800 | 10/1986 | Scourtes et al. | 249/83 |
| 4,635,304 | 1/1987 | Zikmanis et al. | 4/506 |
| 4,818,142 | 4/1989 | Cochran | 405/55 |
| 5,134,819 | 8/1992 | Boyack | 52/169.7 |

*Primary Examiner*—Charles S. Bushey
*Assistant Examiner*—James P. Mackey
*Attorney, Agent, or Firm*—Eugene Stephens & Associates

[57] ABSTRACT

A swimming pool wall is constructed with a partially removable form. The form includes a removable panel for molding an inside surface of the pool wall and a continuous sheet for molding an outside surface of the wall. Sleeves are attached to an outer face of the panel for suspending the panel from partially buried stakes. A series of regularly spaced uprights support the continuous sheet. Braces carried by the uprights space the continuous sheet apart from an inner face of the panel, forming a cavity for pouring the swimming pool wall. Fasteners extend through mounting holes in the panel for removably attaching the panel to the braces.

9 Claims, 6 Drawing Sheets

PARTIALLY REUSABLE SWIMMING POOL WALL FORM

BACKGROUND

Concrete swimming pool walls have been made with both reusable forms and with forms that remain as a part of the swimming pool walls. For example, U.S. Pat. No. 4,818,142 to Cochran discloses reusable swimming pool wall forms that are erected within a ground evacuation. Concrete is poured between the wall forms and the evacuation to form a pool wall. The wall forms are removed to expose an inside surface of the pool wall which is subsequently covered with a vinyl liner.

However, such precise evacuation, which is required to maintain a reasonably uniform pool wall thickness, is exceptionally difficult with conventional evacuation equipment and is impractical in some soils that tend to shift. Erection of the wall form also makes the closely spaced evacuation subject to cave-ins that can require time-consuming repairs.

U.S. Pat. No. 3,748,810 to Mattingly discloses reusable swimming pool wall forms that include outside as well as inside wall forms. The outside wall forms are erected first within an evacuation site. After leveling the outside wall forms, the inside wall forms are connected to the outside wall forms with so-called "ty-cone assemblies" and support straps. An upper portion of the outside wall forms is shaped to enclose, together with the inside wall forms, an enlarged space that is used to form a surrounding deck. The inside wall forms are removed first to enable the inside surface of the swimming pool wall to be cleaned and painted. The outside wall forms remain in place while the inside surface of the pool is treated but are removed prior to backfilling the remaining evacuation.

Although the outside wall forms allow the evacuation to be made with customary precision, a large evacuation is needed to provide sufficient access space to disassemble the outside wall forms after the pool wall has sufficiently cured. The disassembly of the outside wall forms within the remaining space of the evacuation is difficult and time consuming. Forms for both the inside and outside surfaces of pool walls are also expensive to maintain, store, and transport to pool construction sites.

Swimming pool wall forms that remain as exterior surfaces of concrete swimming pool walls are known, for example, from my U.S. Pat. No. 4,407,102. Both the inside and the outside wall forms are made from continuous strips of a resin material. However, the resin material of the inside wall forms is reinforced with fiber glass to resist bowing from the weight of poured concrete. The inside wall forms are also reinforced by vertical channels enclosing T-head stakes. Vertical braces are connected to the outside wall forms, and the T-head stakes and the vertical braces are interconnected by latches.

Although my permanent wall forms are easy to erect and require no disassembly, the inside and outside wall forms of resin material along with the supporting channels, stakes, braces, and latches contribute to a high cost in materials for making the pool walls. The inside wall forms are particularly expensive. In addition to providing structural strength necessary for supporting poured concrete without bowing, the inside wall forms must be waterproof and have a good appearance. The T-head stakes supporting the inside wall forms are also more costly than conventional bar materials providing similar reinforcement after the pool wall has cured.

U.S. Pat. No. 3,468,088 to Miller discloses another example of a swimming pool wall form in which the inside wall form is a continuous sheet reinforced by a fiber glass material, and the outside wall form is a continuous sheet of resin material. A series of H-shaped vertical supports interconnect the two sheets. Channels attached to the fiber glass sheet engage the H-shaped supports with an interlock. Removable rods hold the sheet of resin material within pockets of the H-shaped supports.

The resin sheeting can be removed and presumably reused as another outside wall form. However, the much more expensive fiber glass sheet and reinforcing structures remain as a part of the pool wall. Also, the H-shaped supports separate the concrete into discrete sections that can weaken the pool wall.

SUMMARY OF INVENTION

My invention simplifies and reduces costs of constructing concrete swimming pool walls. Construction is simplified compared to the prior reusable wall forms which require more disassembly, and costs are reduced compared to the prior use of non-reusable wall forms which include more expensive materials that remain as permanent parts of swimming pool walls.

One example of my invention includes a removable fiber glass panel for molding an inside surface of a swimming pool wall. Sleeves spaced apart on an outer face of the panel secure the panel to partially buried stakes. A continuous sheet of resin material for molding an outside surface of the swimming pool wall is supported at regular intervals by a series of uprights. Braces carried by the uprights space the sheet apart from an inner face of the panel forming a cavity for pouring the swimming pool wall. Fasteners extend through mounting holes in the panel for removably attaching the panel to the braces.

The sheet, uprights, and braces are relatively inexpensive components and can remain as parts of the swimming pool wall without adding significant material costs to pool construction. However, the more expensive panel, which must be sufficiently smooth and rigid to mold the inside surface of the pool wall, can be removed for constructing other pool walls. A minimum of evacuation space is also required because the sheet and supporting components for molding the outside surface of the swimming pool wall can remain in place with the pool wall.

Preferably, a portion of the upright between two of the braces is adapted to be bent away from the panel to enlarge a portion of the cavity for forming a bond beam. For example, the upright can be formed with a bar that is notched for bending the upright away from the panel. The uppermost of the two braces straddling the notch is pivotally mounted on the bar for realigning an end of the uppermost brace with one of the mounting holes in the panel after the upright is bent. An extended fastener attaches the uppermost brace to the panel through the realigned mounting hole.

The uprights are also preferably made with slotted sleeves for receiving folds of the sheet. Dowels capture the folds of the sheet within the slotted sleeves of the uprights. One end of the dowels is pointed for threading the folds within the slotted sleeves. However, the dowels can be partly broken to permit the uprights and sheet to be bent away from the panel.

Bottoms of the panels can be strengthened against bowing from the weight of poured concrete by securing a fiber glass reinforcing strip on the outer face of the panels. The strip is positioned below the stake sleeves and is aligned with the bottom of the panel. Further reinforcement from bowing can be achieved by mounting lateral supports between the stake sleeves and inserting wedges between the lateral supports and the panel. The wedges exert a force against the panel opposed to the force applied by the weight of the poured concrete.

DETAILED DESCRIPTION

Figure 1:
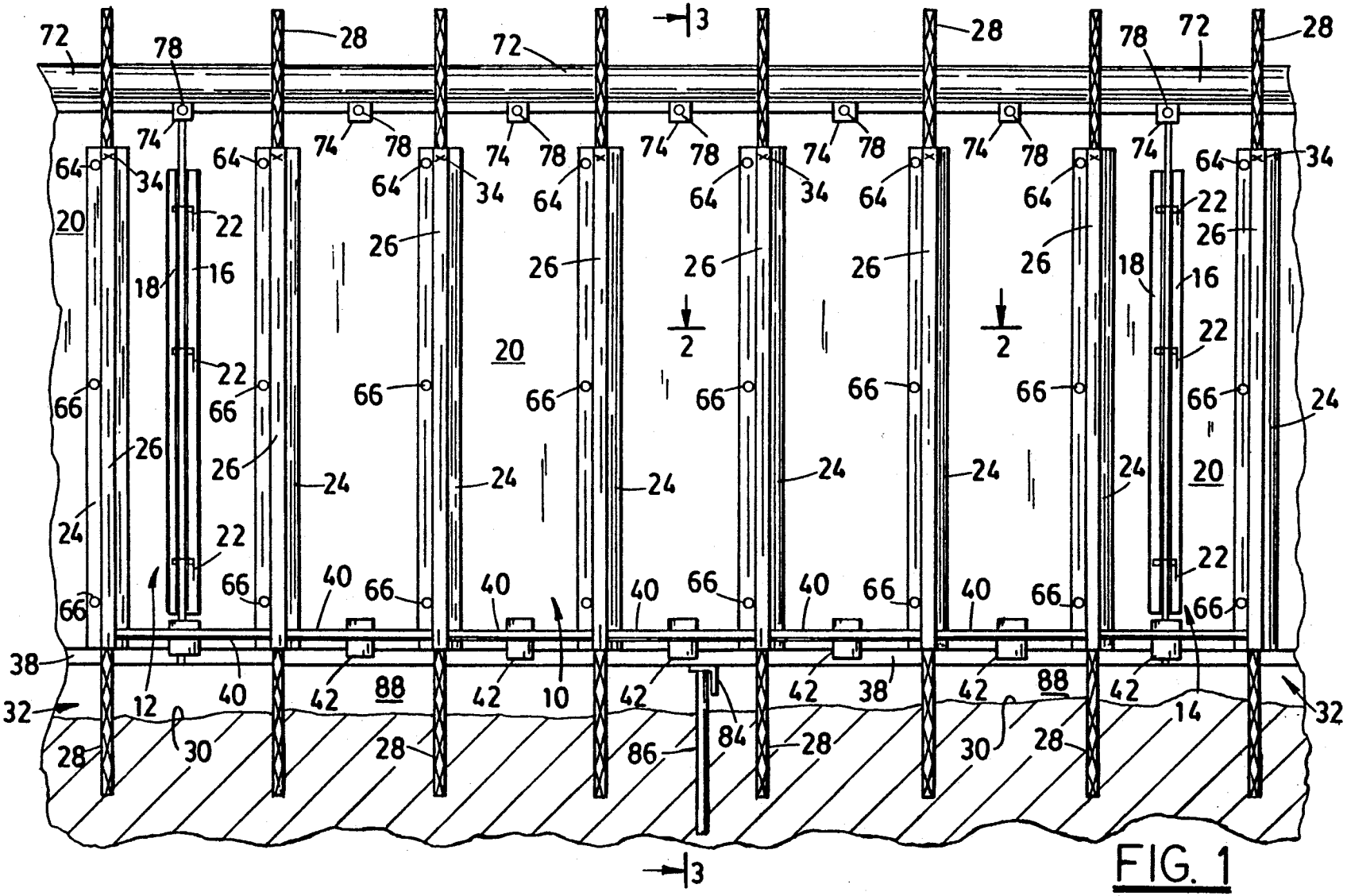
FIG. 1 is a front view showing a removable panel of my wall form adjoining two other panels prior to filling my wall form with concrete.

One example of my partially removable swimming pool wall form is illustrated in the drawing figures. FIG. 1 shows a fiber glass panel 10 connected to adjacent fiber glass panels 12 and 14. Angle bars 16 and 18 are mounted vertically at opposite ends of each panel on an outer face 20 and are joined together by clamps 22 for arranging the panels as a continuous shutter.

Figure 2:
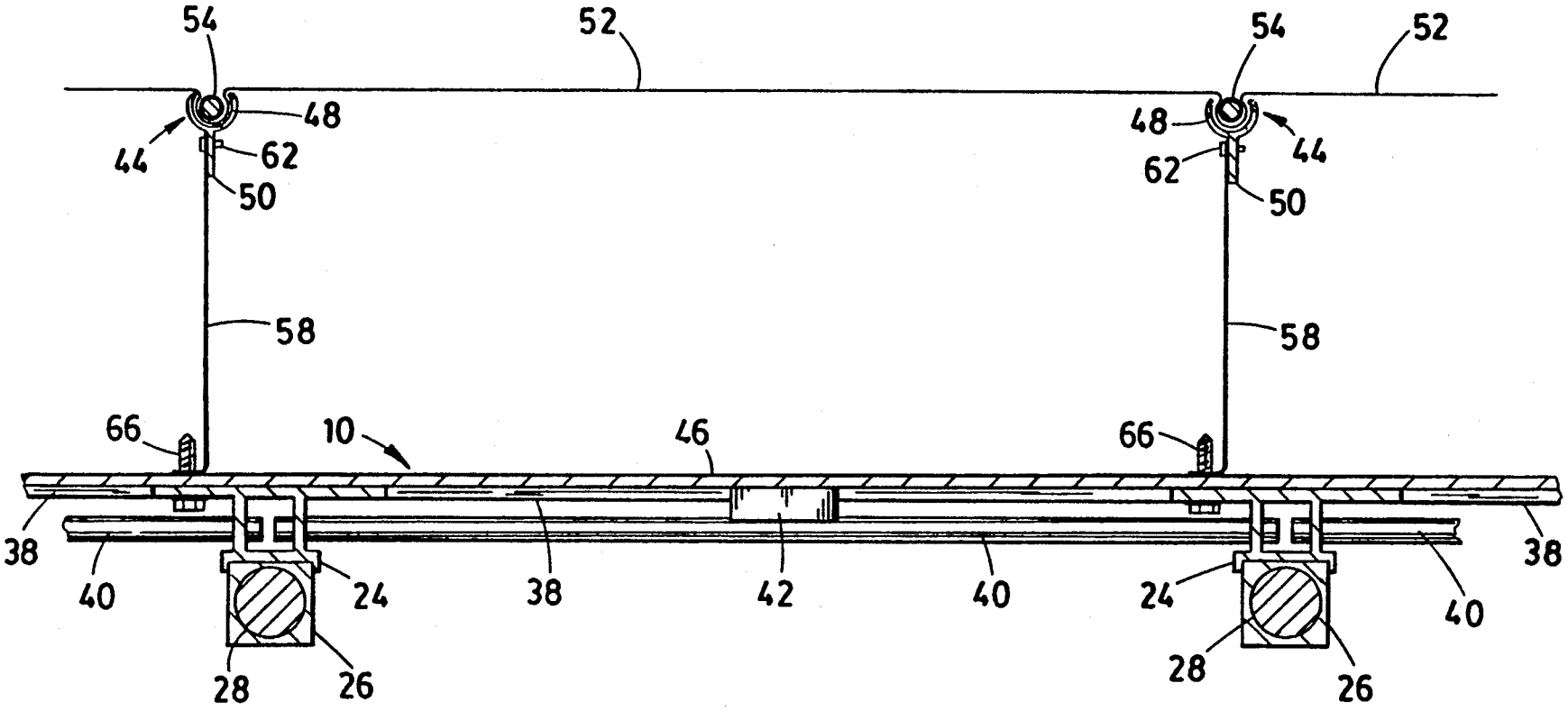
FIG. 2 is a relatively enlarged top cross-sectional view along a portion of the length of the removable panel taken along line 2—2 of FIG. 1.

A series of T-shaped flanges 24 made of a polyvinyl chloride material (i.e., PVC) are also mounted vertically on the outer face 20 at evenly spaced intervals along respective lengths of the panels. The T-shape of the flanges 24 is best seen in the enlarged top view of FIG. 2. Steel sleeves 26 are mounted on the flanges 24. An acrylic adhesive is used to bond both the steel sleeves 26 to the T-shaped flanges 24 and the T-shaped flanges to the outer face 20 of the panels.

The steel sleeves 26 receive stakes 28 that are driven into a shelf 30 of a pool evacuation site 32. The stakes are made from steel reinforcing bars. Wire ties 34 threaded through slots 36 in the steel sleeves 26 suspend the panels from the stakes 28 at adjustable heights above the shelf 30.

Fiber glass strips 38 are adhered to a bottom edge of the panels on the outer face 20 for horizontally reinforcing the panel against bowing from the weight of poured concrete. Further reinforcement against bowing is provided by bars 40 and wedges 42. The bars 40 are supported in holes formed in the T-shaped flanges 24, and the wedges 42 apply a force between the bars 40 and the outer face 20 of the panels.

Uprights 44 are spaced at even intervals along an inner face 46 of the panels. The uprights 44 are made from aluminum extrusions that include C-shaped sleeves 48 and flat bars 50. The sleeves 48 receive folds of a continuous sheet 52 of a polymesh vinyl material. Wooden dowels 54 entrap the folds of the continuous sheet 52 within the sleeves 48.

Figure 3:
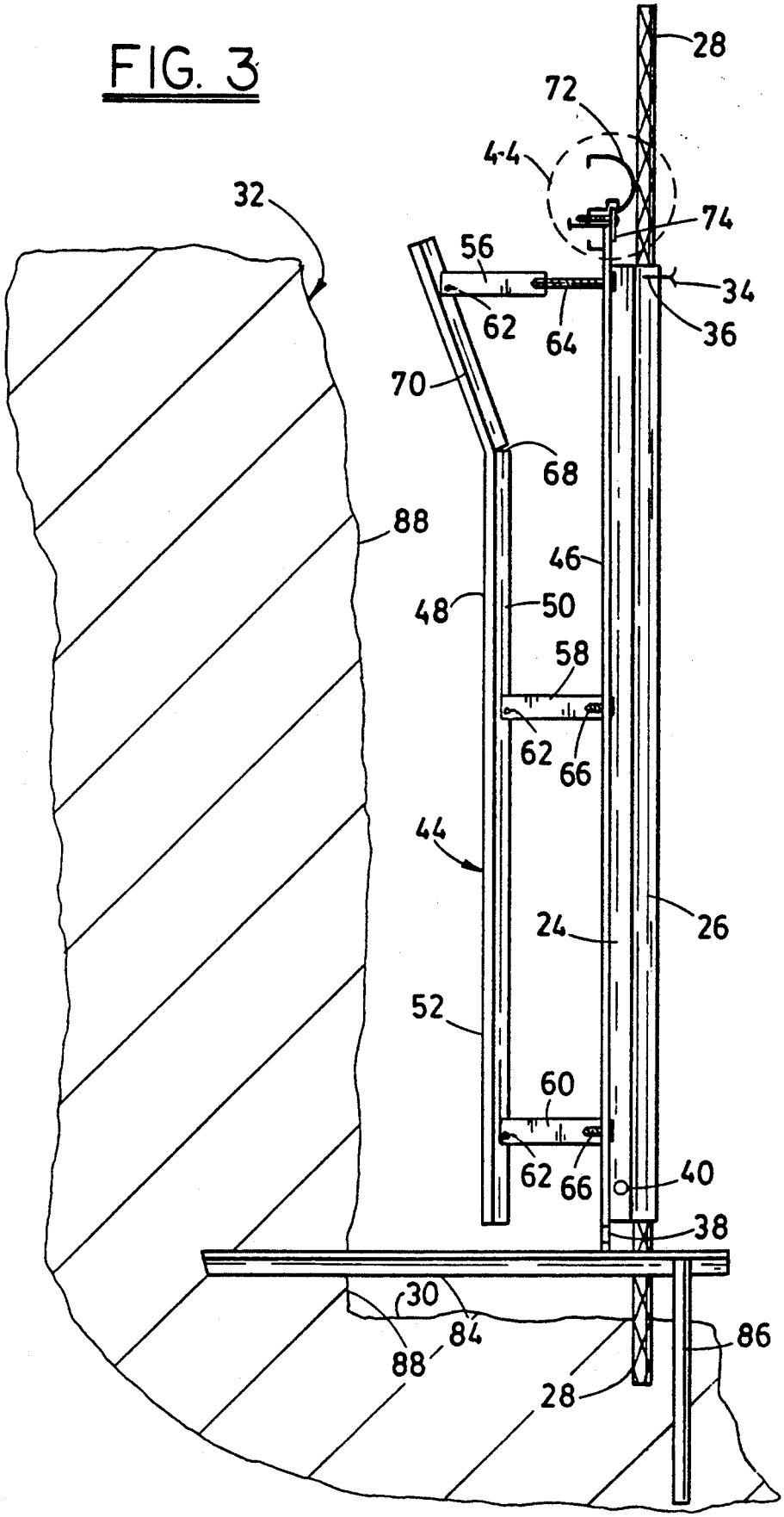
FIG. 3 is a differently enlarged end view through my wall form taken along line 3—3 of FIG. 1.
Figure 5:
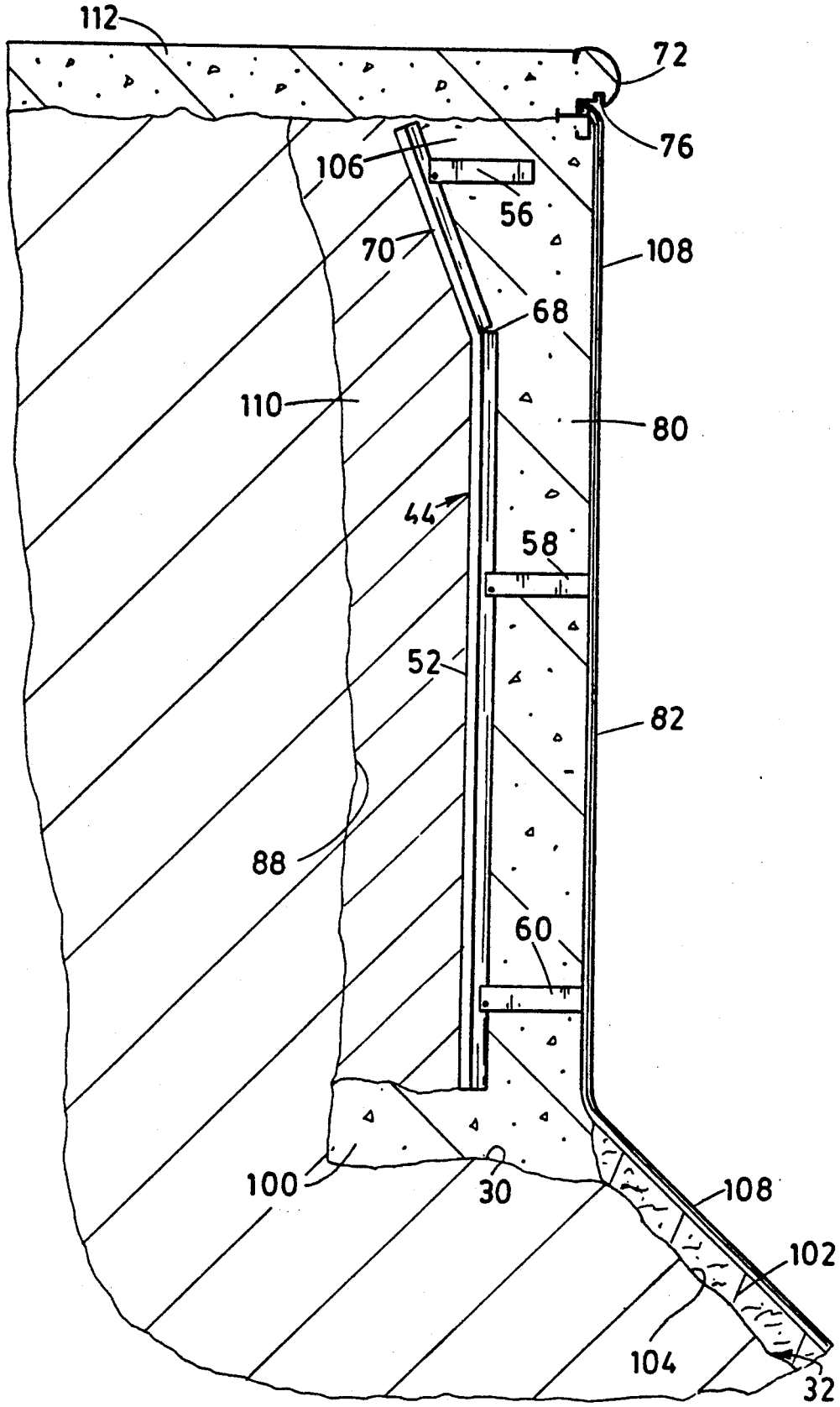
FIG. 5 is a view similar to the view of FIG. 3, but showing a cross section of the finished pool wall.

Three braces shown best in FIGS. 3 and 5 include an upper brace 56, a middle brace 58, and a lower brace 60. Rivets 62 mount a first end of the braces in an off-center position on the bars 50 to restrict one direction of angular movement with respect to the sleeves 48. However, the rivet 62 of upper brace 56 is also positioned to permit a limited angular movement in the opposite direction with respect to the sleeves 48. A second end of the braces is attached to the inner face 46 of the panels with removable screws 64 and 66 that extend into engagement with the braces through respective mounting holes in the panels.

Notches 68 are formed in the bars 50 between the upper braces 56 and intermediate braces 58 to permit upper portions 70 of the uprights to bend away from the inner face 46 of the panels. The notches 68 are preferably precut into the bars 50. However, the notches 68 can also be marked on the bars 50 and cut just prior to bending. Although bending the uprights 44 at the notches 68 cracks the wooden dowels 54, the dowels 54, together with the continuous sheet 52 and sleeves 48, maintain a strong joint between the upper portions 70 and the remainder of the uprights.

The upper braces 56 are pivotable by a limited angular amount about the rivets 62 to maintain the second ends of the upper braces in alignment with their respective mounting holes in the panels. The removable screws 64 are extended in length with respect to the removable screws 66 for engaging the second ends of the upper braces 56 in positions offset from the inner face 46 of the panels. The inner face 46 of the panels and the continuous sheet 52 define a cavity for molding a swimming pool wall. The bent upper portions 70 of the uprights enlarge the cavity to form a funnel for molding a bond beam.

Figure 4:
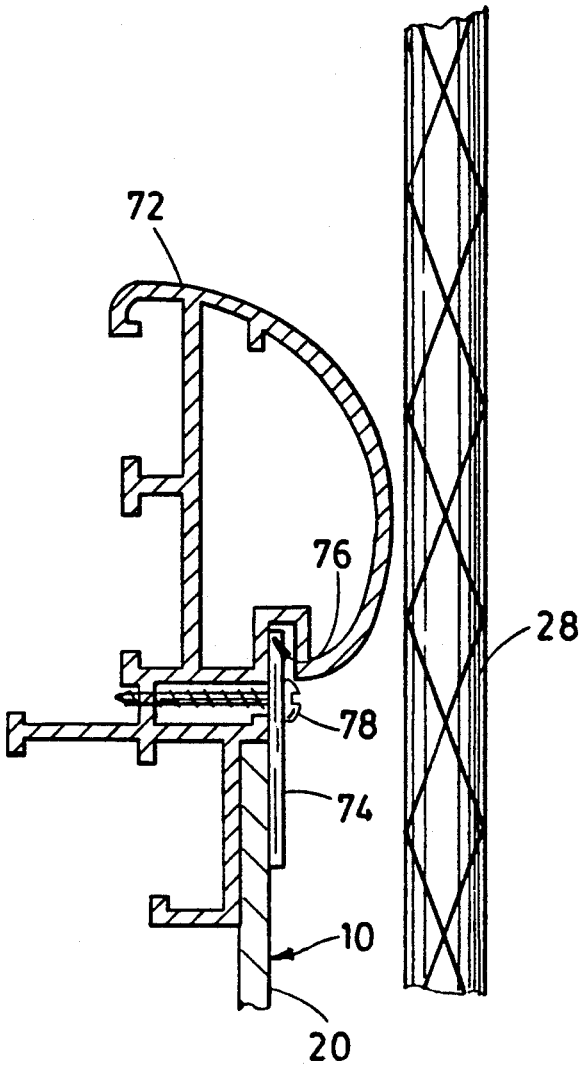
FIG. 4 is a further enlarged fragmentary end view demarcated by line 4—4 in FIG. 3 showing coping temporarily attached to the removable panel.

A bendable swimming pool coping 72 shown best in FIG. 4 is fastened along a top edge of the panels 10, 12, and 14 with retainer clips 74. The T-shaped flanges 24 provide clearance between the coping 72 and the stakes 28. The retainer clips 74 contact a relief joint 76 in the coping and the outer face 20 of the panels. Screws 78 extend through the retainer clips 74 into engagement with the coping 72 for clamping the coping to the panels. Further details of my preferred coping are disclosed in my copending U.S. patent application Ser. No. 680,586, filed Apr. 4, 1991, now U.S. Pat. No. 5,134,819; and this application is hereby incorporated by reference for all of its relevant disclosure.

FIG. 5 shows a cross section of a concrete swimming pool wall 80 that is constructed in accordance with my invention. With reference also to the preceding drawing figures, my partially reusable swimming pool forms are assembled around the shelf 30 for constructing the pool wall 80 within the evacuation site 32.

For example, the panels 10, 12, and 14 are separately leveled and joined together by clamps 22 for arranging the panels as part of a continuous shutter for molding the inside surface 82 of the pool wall. The panels are leveled on horizontal angle bars 84 that are supported by temporary leveling stakes 86. The leveling stakes 86 are driven into the shelf 30 to a height determined by a transit instrument. The horizontal angle bars 84 rest on the leveling stakes 86 and are driven into a vertical wall 88 at the same height.

The panels are positioned on the angle bars 84 for locating the inside surface 82 of the pool wall. Straightening bars (not shown) can be clamped to the angle bars for helping to align the panels. The stakes 28 are inserted through the sleeves 26 of the positioned panels and are driven into the shelf 30. The wire ties 34 threaded through the slots 36 in the sleeves are twisted to suspend the panels from the stakes 28 at the desired height. After the panels have been secured to the stakes, the angle bars 84, leveling stakes 86, and any straightening bars can be removed.

Figure 6:
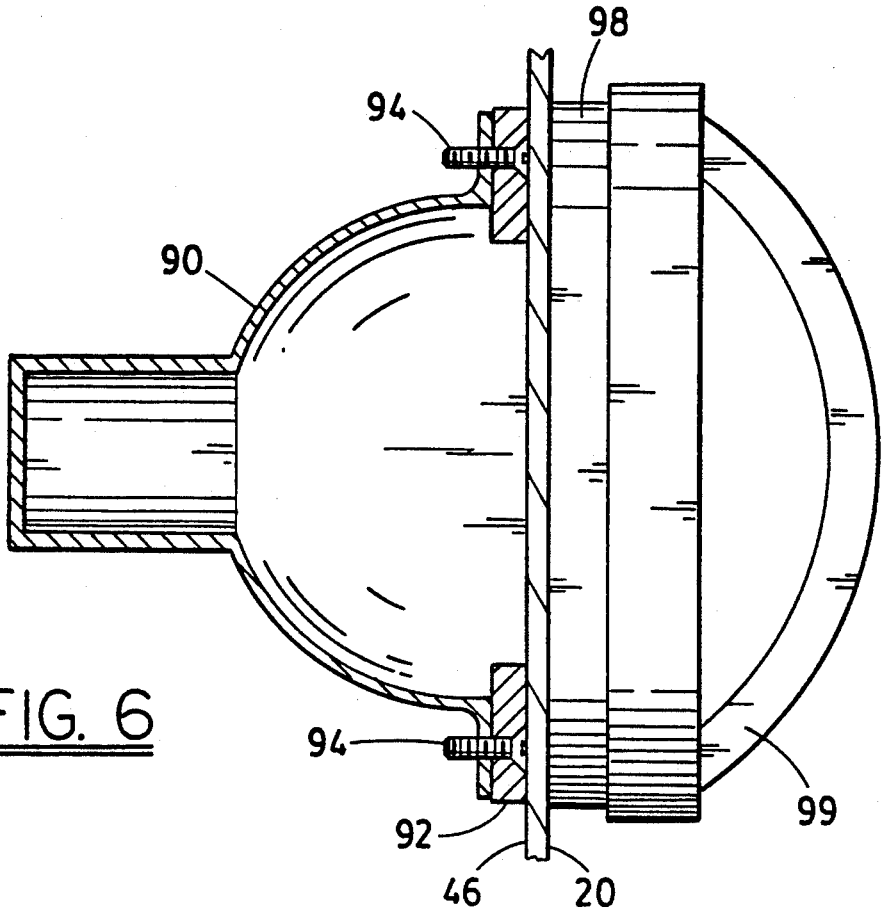
FIG. 6 is a cross-sectional view of a light fixture temporarily mounted to the removable panel with a magnet.
Figure 7:
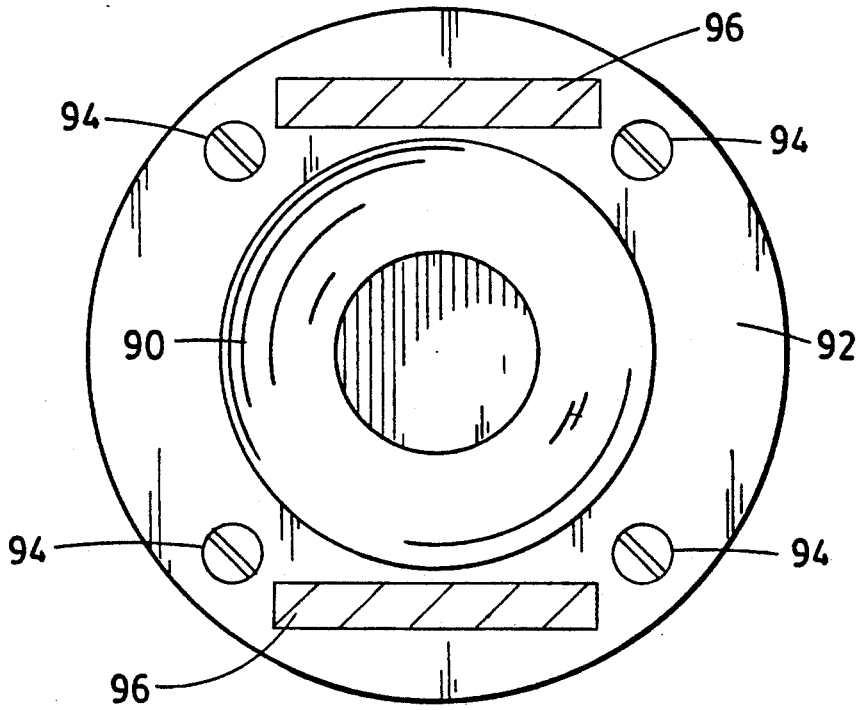
FIG. 7 is a front view of a ferromagnetic plate attached to the light fixture.

Wall fixtures, such as light fixture 90 shown in FIGS. 6 and 7, and pool plumbing lines are secured in desired positions behind the panels. For example, a ferromagnetic mounting plate 92 (e.g., a steel plate) is attached to the light fixture 90 with recessed screws 94. An anti-slip agent 96 (e.g., double-sided tape or folded single-sided tape) is applied to the steel plate 92; and the plate 92, along with the attached light fixture 90, is positioned against the inner face 46 of the panels. A similarly sized magnet 98 attached to a handle 99 is placed against the outer face 20 of the panels for holding the steel plate 92 in place with magnetic attraction. This allows fixtures, such as the depicted light fixture 90, to be positioned in the pool wall without making openings in the panels.

A matrix of reinforcing bars (not shown) are also positioned adjacent to the inner face 46 of the panels. After the reinforcing bars have been installed, the uprights 44 are attached to the panels by fastening the braces 56, 58, and 60 to the inner face 46 of the panels. The braces are fastened to the panels by inserting screws 66 through the holes in the panels into threaded engagement with the second ends of the braces.

Folds in the continuous sheet 52 are threaded into the C-shaped sleeves 48 with a pointed end of the dowels 54. After the dowels 54 are fully inserted and the continuous sheet 52 has been captured in place within the sleeves 48, the upper portions 70 of the uprights are bent away from the inner face 46 of the panels. The bends are made between the upper braces 56 and intermediate braces 58. The upper braces 56, which are moved together with the upper portions 70, are pivoted on the rivets 62 to regain alignment with their respective mounting holes in the panels. The longer screws 64 are inserted through the respective mounting holes into engagement with the realigned ends of the upper braces.

The flexible coping 72 is fastened to the top edge of the panels with retainer clips 74. Screws 78 extend through the retainer clips 74 into engagement with the coping 72 for clamping the coping to the panels. The straightening bars can also be secured to the stakes 28 for helping to align straight sections of the coping.

Concrete is poured into the cavity defined between the inner face 46 of the panels and the continuous sheet 52, and the concrete spreads out to form an enlarged footing 100. The concrete fills the cavity between the inner face 46 of the panels and the continuous sheet 52 for molding the pool wall 80. The braces 56, 58, and 60 are enveloped within the wall as reinforcing elements. The upper portions 70 of the uprights position the continuous sheet to form an enlarged opening or funnel for filling the cavity. The enlarged opening also molds the concrete into a bond beam 106 for strengthening the pool wall. The concrete fills the enlarged opening to a height that covers a portion of the coping 72.

After curing the concrete for less than three hours, the stakes 28 are removed from the sleeves 26 by untwisting the ties 34 and breaking the stakes loose from the pool bottom. The retaining clips 74 are removed from the coping 72; and any magnets, such as the magnet 98, are removed from the panels 10, 12, and 14. The screws 64 and 66 are also removed for detaching the panels 10, 12, and 14 from the braces 56, 58, and 60. The removal of the panels 10, 12, and 14 exposes the inside surface 82 of the pool wall. Any mounting plates, such as the plate 92, can also be detached, leaving the desired fixture exposed in the inside surface 82 of the pool wall. The uprights 44 and the braces 56, 58, and 60 remain embedded in the concrete.

A pool bottom 102 shown in FIG. 5 is shaped by hand with a mixture of vermiculite and cement against an inner evacuation slope 104. However, the pool bottom 102 could also be made of concrete as a part of a continuous pour by raising the panels and further enlarging the footing 100.

The inside surface 82 of the pool wall is treated for waterproofing by suspending a vinyl liner 108 from the coping 72 as shown in FIG. 5. Alternatively, a conventional plaster mix could be applied as waterproofing to the inside surface 82 of the pool wall and an integrally formed concrete bottom. The pool can be filled with water after the water-proofing treatment is completed.

An evacuation space 110 between the vertical wall 88 and the continuous sheet 52 is backfilled to the top of bond beam 106. A finished concrete deck 112 is poured against the coping 72 and on top of both the bond beam 106 and the backfilled evacuation space 110. Other conventional operations such as the completion of electrical wiring and plumbing, as well as the installation of steps, ladders, diving boards, and slides, can be incorporated into the pool at appropriate times in the construction.

I claim:

1. A partially removable swimming pool wall form comprising:

a removable panel having inner and outer faces and a plurality of mounting holes;

a sleeve attached to said outer face of the panel for attaching said removable panel to a partially buried stake;

a continuous sheet forming a cavity with said inner face of the panel for pouring a swimming pool wall;

an upright for supporting said sheet;

braces connected to said upright for temporarily attaching said upright to said panel through said mounting holes; and fasteners extending through said mounting holes for removably attaching said panel to said braces.

2. The wall form of claim i in which said braces are spaced apart along said upright for envelopment within the swimming pool wall as reinforcing elements.

3. The wall form of claim 2 in which a portion of said upright between two of said braces is adapted to be bent away from said panel to enlarge a portion of the cavity for forming a bond beam.

4. The wall form of claim 3 in which said upright is formed with a bar, and a notch is formed in said bar for bending said upright away from said panel.

5. The wall form of claim 4 in which said braces are connected to said bar.

6. The wall form of claim 5 in which an uppermost of said two braces is pivotable with respect to said upright for realigning an end of said uppermost brace with one of said mounting holes after said upright is bent.

7. The wall form of claim 6 in which one of said fasteners is extended to attach said uppermost brace to said panel through said one mounting hole.

8. The wall form of claim 7 in which said upright is formed with a slotted sleeve for receiving a fold of said sheet.

9. The wall form of claim 8 in which a bendable dowel is used for capturing the fold of said sheet within said slotted sleeve of the upright.

* * * * *